US005444929A

United States Patent [19]

Joseloff

[11] Patent Number: 5,444,929

[45] Date of Patent: Aug. 29, 1995

[54] APPARATUS FOR THE DISPLAY OF A MULTIPLICITY OF OBJECTS OR PICTURES

[76] Inventor: Michael Joseloff, 1148 Fifth Ave., Apt. 9D, New York, N.Y. 10128

[21] Appl. No.: 101,457

[22] Filed: Aug. 2, 1993

Related U.S. Application Data

[63] Continuation-in-part of Ser. No. 816,609, Dec. 31, 1991, abandoned.

[51] Int. Cl.[6] ..... G09F 7/00

[52] U.S. Cl. ..... 40/152.1; 40/657; 40/622

[58] Field of Search ..... 40/152.1, 663, 611, 40/642, 657, 668, 605, 622, 152, 622

[56] References Cited

U.S. PATENT DOCUMENTS

| | | | |
|---|---|---|---|
| 955,745 | 4/1910 | Bailey | 40/622 |
| 1,859,755 | 5/1932 | Thompson | 40/622 |
| 3,566,529 | 4/1971 | Kner et al. | 40/154 |
| 4,505,061 | 4/1985 | Neuberger et al. | 40/622 |

*Primary Examiner*—Kenneth J. Dorner
*Assistant Examiner*—Cassandra Davis
*Attorney, Agent, or Firm*—Arthur L. Plevy

[57] ABSTRACT

A display apparatus having a grid structure comprised of slats with a uniform thickness and at least one frame to display a framed object. The frame selectively attaches to the grid structure in a manner that provides the appearance that the frame is part of the grid structure, thereby providing an ordered and aesthetically pleasing display.

17 Claims, 4 Drawing Sheets

APPARATUS FOR THE DISPLAY OF A MULTIPLICITY OF OBJECTS OR PICTURES

RELATED APPLICATIONS

This application is a continuation-in-part of U.S. patent application No. 07/816,609 filed Dec. 31, 1991 now abandoned and also entitled APPARATUS FOR THE DISPLAY OF A MULTIPLICITY OF OBJECTS OR PICTURES.

FIELD OF THE INVENTION

The present invention relates to an apparatus for displaying a plurality of pictures or other planar objects in an aesthetically pleasing manner on a common support. More particularly, the present invention relates to a large grid structure used in conjunction with mounting elements to retain different sized pictures on the grid structure and provide an ordered and aesthetically pleasing display.

BACKGROUND OF THE INVENTION

Photographs are commonly framed and displayed by individuals for their sentimental and/or aesthetic value. Many individuals have several different photographs, of various sizes, they would like to display. However, prior art display devices often limit the number of photographs that can be displayed in an aesthetically pleasing manner. For example, photographs are often placed in free standing frames that are then mounted on a wall or placed on a desk or another piece of furniture. However, when several photographs are displayed, the individual frames become cumbersome. Similarly, if hung on a wall, multiple frames are difficult to align so that the frames are all straight and equidistant from one another. Furthermore, it is difficult to display a plurality of different sized frames in a space efficient and aesthetically pleasing manner.

In the prior art there are large single frame structures that are designed to hold and display a plurality of photographs in a predetermined mosaic. The problem with mosaic type displays is that it is very difficult to change or replace individual photographs that are being displayed. Furthermore, photographs and other pictures come in a wide variety of sizes. Many prior art frame structures designed to hold a plurality of photographs require that they be a particular shape or size in order to fit properly within the mosaic. Another disadvantage of such prior art display structures is that the photographs to be displayed must be placed in a predetermined ornamental arrangement, thereby limiting the ability of a person to creatively display the photographs.

It is therefore an object of the present invention to provide a display assembly that allows a plurality of photographs of different sizes to be displayed in a space efficient and aesthetically pleasing manner.

It is a further object of the present invention to provide a display assembly whereby a plurality of photographs can be displayed in any desired ornamental arrangement.

It is yet another object of the present invention to provide a display assembly where any number of generally planar objects such as photographs, diplomas, plaques and the like can be displayed in any combination on a common surface in an ordered and aesthetically pleasing manner.

SUMMARY OF THE INVENTION

The present invention is a display apparatus for displaying a plurality of planar objects, such as photographs or the like, in an ordered and aesthetically pleasing manner. In a first preferred embodiment, the present invention display apparatus includes a grid structure comprised of a plurality of vertical slats that intersect a plurality of horizontal slats in a common plane. Both the vertical slats and the horizontal slats have a uniform thickness. As such, the intersection of the vertical slats and the horizontal slats creates a uniform grid.

Frames are provided into which flat objects, such as photographs, diplomas, drawings or the like can be inserted. Each frame is comprised of framing elements that define the periphery of the frame. Preferably, each of the framing elements on a frame are formed to have the same thickness and appearance as the slats comprising the grid structure. Furthermore, an attachment means is joined to each frame that is used to attach the frame to the grid structure. The frame is sized, and the attachment means are positioned, so that as the frame is attached to the grid structure each of the framing elements on the frame aligns directly against a horizontal and vertical slat or may lie parallel to these slats on the grid structure. Since the flaming elements have the same thickness and appearance as the slats in the grid structure, the framing elements appear to be a unistructural part of the overall grid structure. As a result, the alignment of the flames on the grid structure creates an ordered, aesthetically pleasing display regardless of how many individual frames are actually placed on the grid structure.

In a slightly different embodiment of the present invention, the frames may be sized so that the flaming elements do not align directly along the horizontal and vertical slats of the grid structure. Rather, the flaming elements of each frame may be disposed between the slats as the frames are mounted on the grid support. The framing elements lay parallel to the slats, thereby providing an ordered and aesthetically pleasing display.

In another alternate embodiment of the present invention, the flames used to retain the flat object to be displayed does not have framing elements defining a peripheral border. Rather, in this embodiment the flat objects to be displayed are attached to a planar support. The planar support is sized so that when it is attached to the grid support, the edges of each planar support align with the vertical and horizontal slats of the grid support, thereby creating an appearance that the slats on the grid are the flaming elements for the picture being displayed.

BRIEF DESCRIPTION OF THE DRAWINGS

For a better understanding of the present invention, reference is made to the following description of exemplary embodiments thereof, considered in conjunction with the accompanying drawings; in which.

DETAILED DESCRIPTION OF THE INVENTION

Although the present invention can be used in many different applications where a planar object such as a diploma, poster, painting, or the like is to be displayed, the present invention is especially suitable for use in displaying photographs. Accordingly, the present invention will be described in connection with the display of photographs of various sizes.

Figure 1:
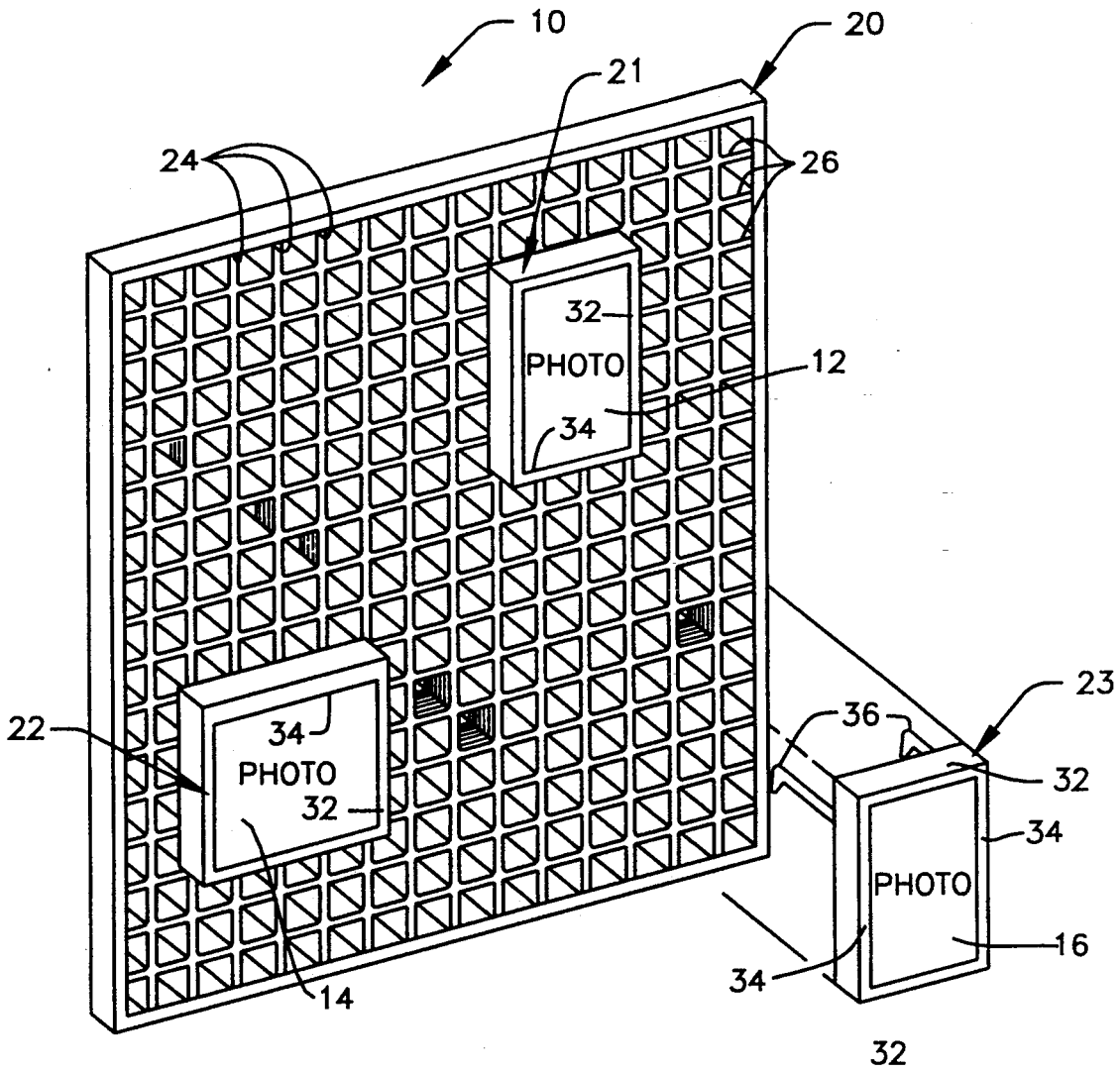
FIG. 1 shows a perspective view of one preferred embodiment of the present invention display apparatus used to display a plurality of photographs.
Figure 2:
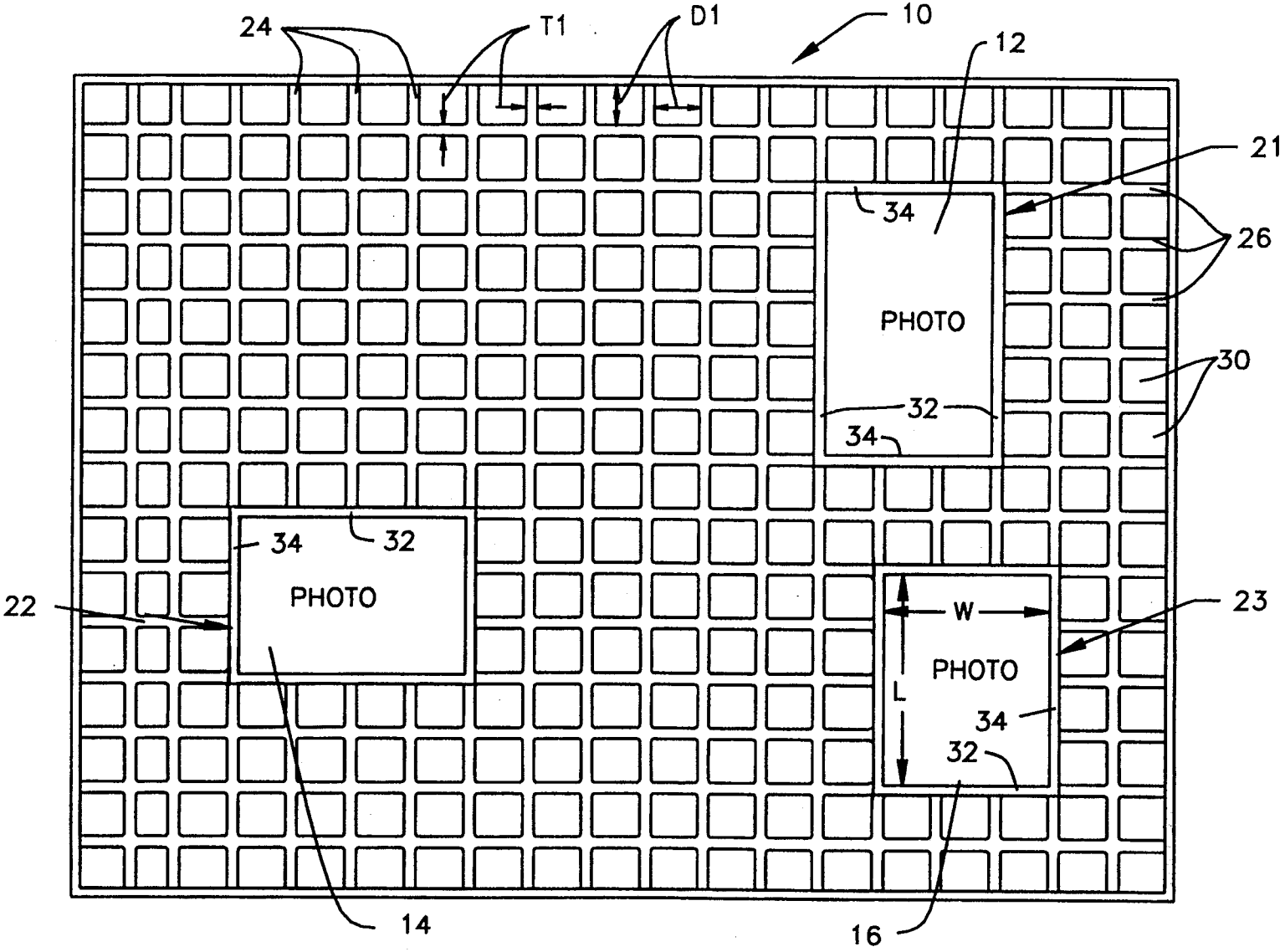
FIG. 2 shows a front view of the embodiment of the present invention shown in FIG. 1.

Referring to FIGS. 1 and 2, one preferred embodiment of the present invention display apparatus 10 is shown. In this embodiment, various photographs 12, 14, 16 are being displayed. The present invention display apparatus 10 is comprised of a support grid 20 and various frames 21, 22, 23 that retain the photographs 12, 14, 16 and join the same to the support grid 20. The support grid 20 is comprised of a plurality of parallel vertical slats 24 and parallel horizontal slats 26. The vertical slats 24 and the horizontal slats 26 are disposed in a common plane. As such, the intersection of the vertical slats 24 with the horizontal slats 26 creates a plurality of open compartments 30 within the support grid 20. Although the support grid 20 is described as having vertical and horizontal slats 24, 26, the vertical slats 24 and the horizontal slats 26 need not be separate elements. Rather, the support grid 20 may be molded of plastic, cast in metal or cut from a solid material. As a result, the vertical slats 24 and horizontal slats 26 may be unistructurally formed.

Both the vertical slats 24 and the horizontal slats 26 have the same thickness T1. Additionally, the depicted distance D1 (FIG. 2) between adjacent vertical slats 24 and adjacent horizontal slats 26 is also the same. In a preferred embodiment, the number of vertical slats 24 per unit distance is equivalent to the number of horizontal slats 26 in the same unit of distance. As a result, each of the open compartments 30 is square and is defined on the top and bottom by horizontal slats and both sides by the vertical slats. For a purpose which will be later explained, the distance D1 between any two parallel slats, plus the thickness T1 of any one slat should equal approximately one inch (2.54 cm.) or a multiple thereof.

The photographs 12, 14, 16 are inserted and held within the frames 21, 22, 23. Each of the frames 21, 22, 23 is comprised of two vertical framing elements 32 and two horizontal framing elements 34 that define a rectangular or square framed region. The vertical framing elements 32 and the horizontal framing elements 34 have a thickness T2 that is generally equivalent to the thickness T1 of the vertical and horizontal slats 24, 26 on the support grid 20. Furthermore, the vertical framing elements 32 and the horizontal flaming elements 34 are preferably formed from the same type of material as the support grid 20 or formed from a material that appears to be the same material as the support grid 20.

The frames 21, 22, 23 defined a framed area having a length L and a width W that are multiples of one inch (2.54 cm). In a preferred embodiment, the frames 21, 22, 23 are shaped to accomodate the dimensions of standard photographs, i.e. $3\frac{1}{2}\times5$ in, 4 in$\times$6 in, 5 in$\times$7 in and 8 in$\times$10 in. The frames 21, 22, 23 retain the photographs 12, 14, 16 by any known prior art method for holding pictures within a frame. Attachment elements 36 extend from the back surface of each frame 21, 22, 23. The attachment elements 36 engage the support grid 20 and interconnect the support grid 20 to the frames 21, 22, 23. As each of the frames 21, 22, 23 attach to the support grid 20, the vertical framing elements 34 of each frame align directly above two of the vertical slats 24 on the support grid 20. Similarly, the horizontal framing elements 32 of each frame align directly above two of the horizontal slats 26 on the support grid 20. Since the vertical framing elements 34 and the horizontal framing elements 32 have the same appearance as the slats 24, 26 on the support grid 20 and have the same thickness T1 as the slats 24, 26, the frames 21, 22, 23 appear to be part of the support grid 20. The frames 21, 22, 23 appearing to be an integral part of the support grid 20 adds continuity and aesthetics value to the display. As a result, any plurality of flamed items can be displayed in any position on the support grid 20 thereby providing an ordered and aesthetically pleasing display. Since the frames 21, 22, 23 can be made in any desired size, multiple items of different sizes such as photographs, diplomas, postcards and the like, can be displayed without disrupting the ordered aesthetic value of the overall display.

In the preferred embodiment, the support grid 20 is sized so that the distance D1 between parallel adjacent slats plus the thickness T1 of any one slat is equal to one inch. These dimensions ensure that as a frame 21, 22, 23 is mounted to the support grid 20, the vertical and horizontal framing elements 34, 32 of the frames 21, 22, 23 align with the vertical and horizontal slats 24, 26 on the support grid 20.

Figure 3:
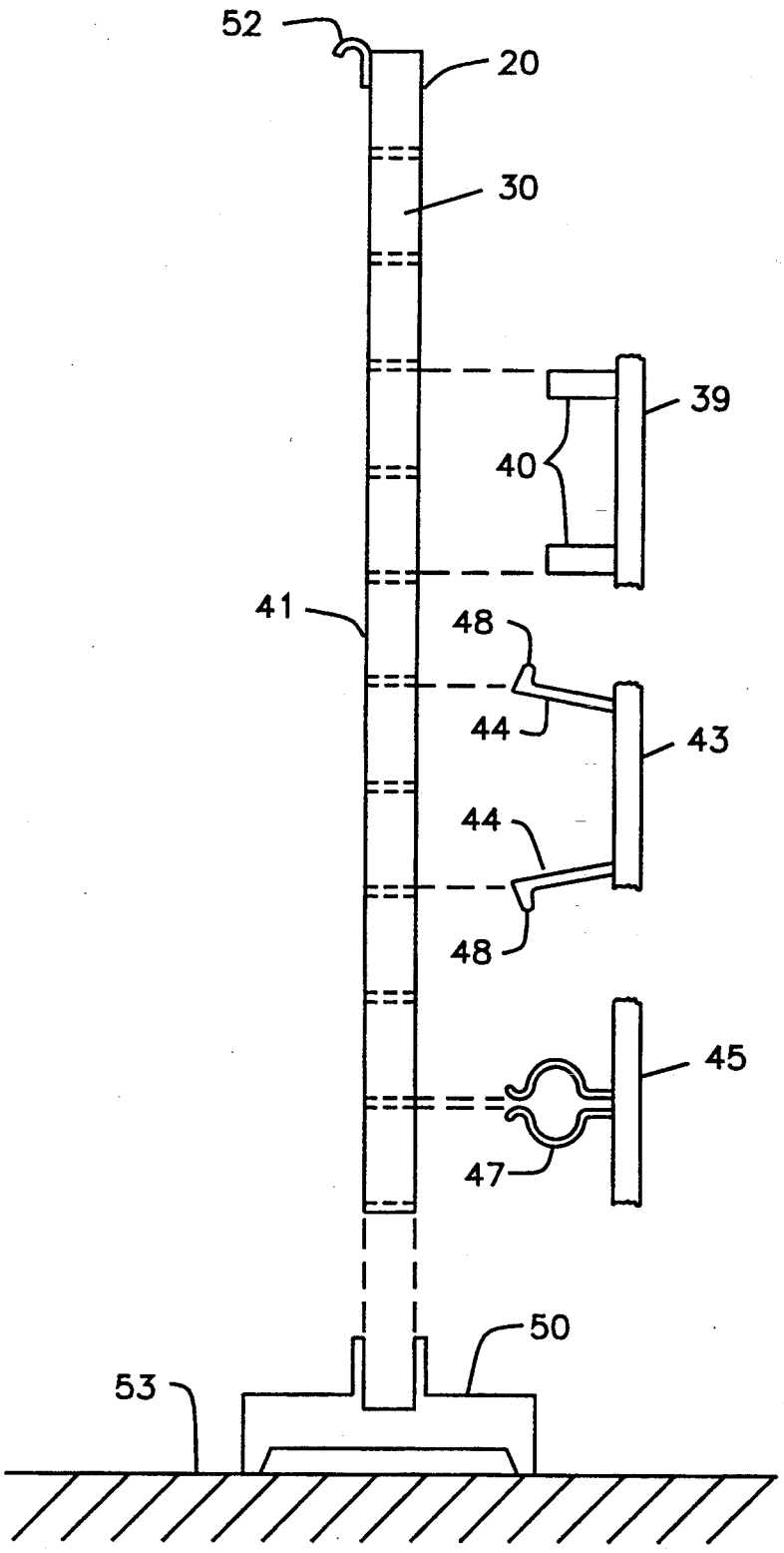
FIG. 3 shows a side view of a preferred embodiment of the present invention display apparatus.

Referring to FIG. 3, it can be seen that the frames can be attached to the support grid 20 by any number of mounting devices. In a first exemplary embodiment a frame 39 is shown having rigid extensions 40 extending from the back surface of the frame 39. The rigid extensions 40 pass into the open compartments 30 on the support grid 20, wherein the rigid extensions 40 are retained in the open compartments by friction. As a result, to change the position of the frame 39 on the support grid 20, the frame 39 need only be pulled away from the support grid 20 and repositioned elsewhere on the support grid 20 as desired.

In a second exemplary embodiment, a frame 43 is attached to the support grid 20 by the use of flexible pawls 44 that extend from the back surface of the frame 43. The flexible pawls 44 nominally do not fit within the open compartments 30 on the support grid 20. However, the flexible pawls 44 can be elastically deformed to a more narrow shape that does fit within the open compartments 30. The resulting interference fit retains the frame 43 in a desired position on the support grid 20. The flexible pawls 44 may also include locking tabs 48 proximate their distal ends. The locking tabs 48 may engage the back surface 41 of the support grid 20 thereby providing a snap-fit that retains the frame 43 in place.

In a third exemplary embodiment, a frame 45 has a spring clamp 47 extending from its back surface. The spring clamp 47 can engage any horizontal slat 26 on the support grid 20. Similarly, if turned, the clamp 47 may engage one of the vertical slats on the support grid. It will be understood that the shown embodiments are merely exemplary and any known mechanism capable of joining a frame to the support grid may be used in conjunction with the present invention.

Despite the mechanism that is used to join the various frames to the support grid 20, the frames engage the support grid 20 so that the vertical and horizontal framing elements of each frame exactly align with the vertical and horizontal slats that comprise the support grid 20. As a result, no matter how many frames are hung on the support grid 20, the vertical and horizontal framing elements of each frame are all parallel and are aligned with the slats of the support grid 20, thereby appearing to be part of the support grid 20. Since each of the frames can be positioned at any point on the support grid 20, one is not restricted in arranging the frames as desired. Despite any arrangement, all the frames are aligned, ordered and maintain an aesthetic appeal.

Since the present invention display apparatus allows individual frames to be attached to the support grid 20, any one frame could be removed, and the photograph within the frame changed, without disturbing the remainder of the displayed frames. Similarly, as more photographs are obtained, additional frames can be added to the support grid 20 without disrupting the frames previously positioned on the support grid 20.

In FIG. 3, the present invention display apparatus 10 is shown in conjunction with an optional base stand 50 and hanging hook 52. The hanging hook 52 can be used to suspend the display apparatus 10 from a wall or another vertical surface. Similarly, wires, brackets or any other known mounting device could be used in place of the hanging hook 52. The base stand 50 can be used in conjunction with the display apparatus 10 to make the display apparatus 10 free standing on a horizontal surface 53. Furthermore, if the display apparatus 10 is made on a large enough scale, the display apparatus may be constructed as a dividing wall or a covering that covers the entire surface area of a wall.

Figure 4:
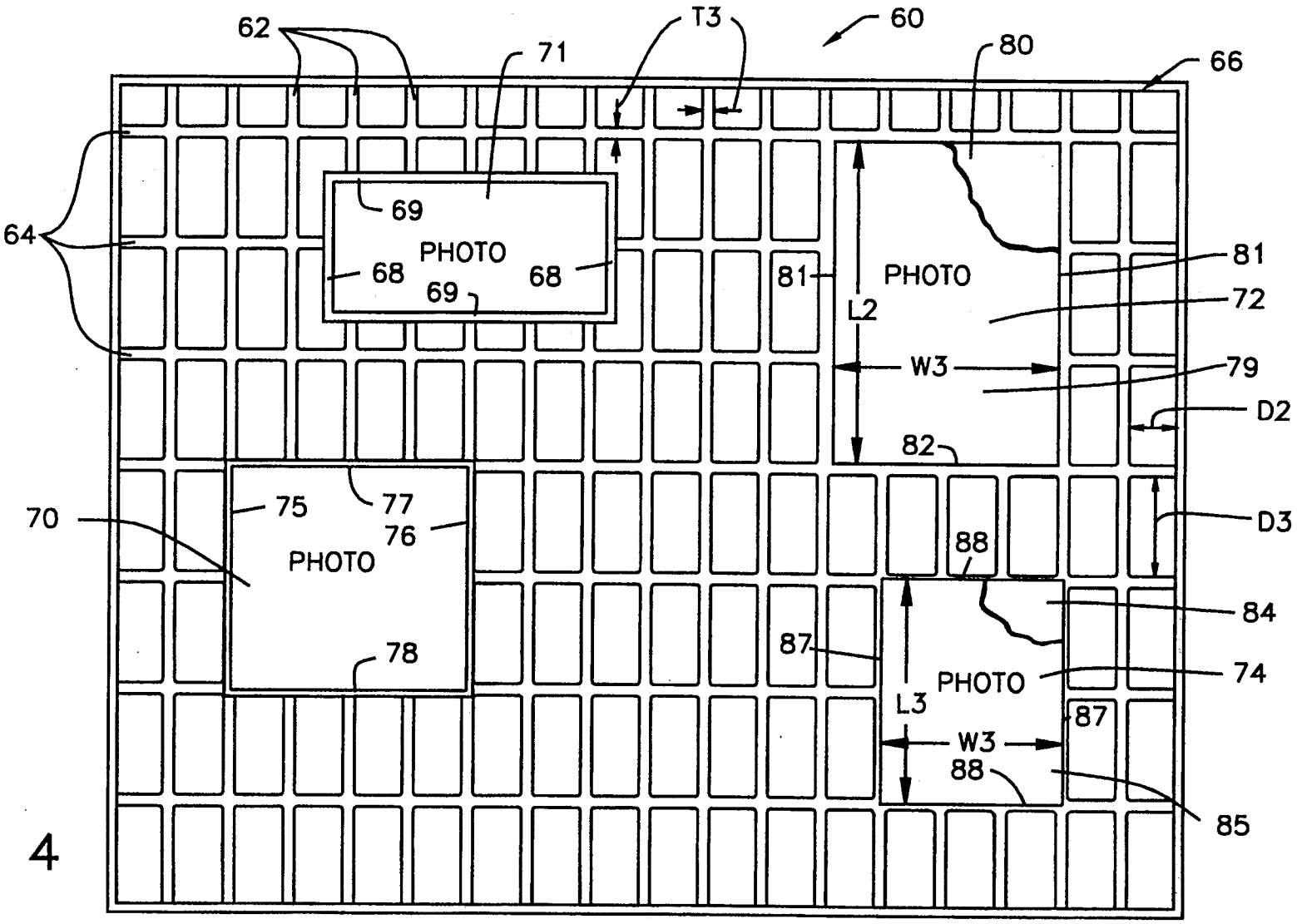
FIG. 4 shows a front view of an alternative embodiment of the present invention display apparatus used to display a plurality of photographs.

Referring to FIG. 4, an alternate embodiment of the present invention display apparatus 60 is shown. As with previous embodiments, the display apparatus 60 is comprised of vertical slats 62 and horizontal slats 64 that form a support grid 66. Both the vertical slats 62 and the horizontal slats 64 have a common slat thickness T3. In the shown embodiment, the number of vertical slats 62 per unit length is greater than the number of horizontal slats 64 per unit length. As a result, the intersection of the vertical slats 62 and the horizontal slats 64 creates a plurality of identical rectangular-shaped open compartments 68 across the support grid 66. The distance D2 between vertical slats 62 and the distance D3 between horizontal slats 64, when added to the thickness T3 of any one slat, are both multiples of one inch, with the distance D3 between horizontal slats 64 being larger than the distance D2 between vertical slats 62. By making the number of vertical slats 62 and horizontal slats 64 disproportionate, less materials can be used in creating the support grid 66 while still providing the needed grid dimensions to accommodate a large number of different sized frames. It will, however, be understood that the choice of having more vertical slats than horizontal slats is merely demonstrative and the grid structure 66 can be formed by having more horizontal slats than vertical.

In FIG. 4, four separate picture support structures 70, 71, 72, 74 are shown in conjunction with the support grid 66. The first support structure 70 is a frame having two vertical framing members 75, 76 and two horizontal framing members 77, 78 that align directly above the vertical and horizontal slats 62, 64 respectively where the vertical framing members 75, 76 and horizontal framing members 77, 78 are narrower than the vertical and horizontal slots 62, 64 respectively. The second support structure 71 is also a frame having horizontal framing elements 69 and vertical framing elements 68. In this embodiment, the horizontal and vertical framing elements 69, 68 do not align directly above the horizontal and vertical slats 64, 62 on the support grid 66. Rather, the horizontal and vertical framing elements 69, 68 lay parallel to the slats, a predetermined distance from the slats, providing an ordered and aesthetically pleasing display.

The third support structure 72, shown in FIG. 4, does not include framing members. Rather, the third support structure 72 is comprised of a planar support 80 onto which a photograph 79 or other planar object is adhesively adhered. In the shown embodiment, the planar support 80 has a length L2 and a width W2 that is dimensioned so that the vertical edges 81 of the planar support 80 align with the edges of two vertical slats 62 and the horizontal edges 82 of the planar support 80 align with the edges of two horizontal slats 64. As a result, when viewed from the front, the vertical slats 62 and the horizontal slats 64 appear to frame the planar support 80 and the photograph 79 it supports. The planar support 80 attaches to the support grid 66 in the same manner as the frames previously described. As such, when applied to the support grid 66 the second support structure 72 creates an ordered and aesthetically appealing display.

The fourth support structure 74, shown in FIG. 4, is also comprised of a planar support 84 onto which a photograph 85 or other object is adhesively applied. In the shown embodiment, the planar support 84 has a length L3 and width W3 that is dimensioned so that the vertical edges 87 of the planar support 84 terminate in the center of two vertical slats 62 and the horizontal edges 88 of the planar support 84 terminate in the center of two horizontal slats 64. As a result, when viewed from the front, the fourth support structure 74 seems to be framed by half the width of two vertical slats 62 and half the width of two horizontal slats 64. Therefore, as the fourth support structure 74 is applied to the support grid 66, an ordered and aesthetically pleasing display is created. Although FIG. 4 shows the edges of planar supports terminating at the center and at the inner edges of the slats, the edges of the planar supports can terminate at a any point along the thickness of the slats including the edge of the slat that is farthest away from the photograph being displayed.

In FIG. 4, the description of photographs being attached to the third and fourth support structures 72, 74 by adhesive is merely exemplary and a photograph or any other planar object may be held in place by any other known method. For instance, the support structures 72, 74 may have a transparent cover under which the photograph can be placed. The use of adhesive is described because it represents the most cost efficient method of retaining the photographs in place.

It should be understood that the embodiments described herein are merely exemplary and that a person skilled in the art may make many variations and modifications to the described embodiment utilizing functionally equivalent components to those described. More specifically, it should be understood that the slats comprising the support grid need not be vertical and horizontal, but rather may be inclined at any given angle. All such equivalent components, variations and modifications are intended claims to be included within the scope of the present invention as defined by the appended claims.

What is claimed is:

1. A display apparatus, comprising:

a support grid having a first plurality of parallel members and a second plurality of parallel members that intersect at a predetermined angle, said first and second parallel members having a uniform thickness thereby defining a plurality of compartments;

at least one frame capable of displaying a planar object, said at least one frame having a peripheral frame border of a thickness generally equal to said uniform thickness, wherein said frame border includes at least first and second nonparallel sides;

attachment means for selectively attaching said at least one frame to said support grid wherein said first side of said frame border aligns in parallel with said first plurality of members and said second side of said frame border aligns in parallel with said second plurality of members.

2. The display apparatus according to claim 1, wherein said frame border aligns directly against two of said first plurality of members and two of said second plurality of members.

3. The display apparatus according to claim 2, wherein said first plurality of members are generally horizontal and said second plurality of members are generally vertical, intersecting said first plurality of members at a perpendicular.

4. The display apparatus according to claim 3, wherein said at least one frame is generally rectangular in shape and defines a framed area having a length and width that are multiples of one inch.

5. The display apparatus according to claim 2, having a plurality of frames of at least two different sizes wherein each frame aligns with said first and second parallel members on the support grid.

6. The display apparatus according to claim 2, wherein said support grid comprises a first material and said at least one frame comprises said first material.

7. The display apparatus according to claim 1, wherein said first plurality of parallel members has the same number of members per unit length as said second plurality of parallel members, thereby forming generally square compartments in said support grid.

8. The display apparatus according to claim 1, wherein said second plurality of parallel members has a different number of members per unit length as said first plurality of parallel members, thereby forming generally rectangular compartments in said support grid.

9. The display apparatus according to claim 1, further including a base support means, coupled to said support grid, for retaining said support grid in a free standing manner on a flat surface.

10. The display apparatus according to claim 1, wherein the distance between a point on one of said first plurality of parallel members and a corresponding point on an adjacent one of said first plurality of parallel members is an even multiple of one inch.

11. The display apparatus according to claim 1, wherein the distance between a point on one of said second plurality of parallel members and a corresponding point on an adjacent one of said second plurality of parallel members is an even multiple of one inch.

12. A method of displaying a plurality of planar objects on a support grid having a plurality of intersecting vertical and horizontal members of a uniform thickness, wherein said vertical and horizontal members define a plurality of identical compartments, comprising the steps of:

providing at least one frame having a frame border with a thickness generally equivalent to said uniform thickness of said vertical and horizontal members;

placing at least one of said planar objects within said at least one frame;

attaching said at least one frame to said support grid at a desired position such that said frame border aligns with at least two of said vertical members and at least two of said horizontal members.

13. The method according to claim 12, wherein said at least one frame is generally rectangular in shape having a length and a width that are multiples of one inch.

14. The method according to claim 12, wherein said support grid comprises a first material and said at least one frame comprises said first material.

15. The method according to claim 12, wherein said first plurality of parallel members has a given number of members per unit length, and said second plurality of parallel members has said given number of members per unit length, thereby forming generally square compartments in said support grid.

16. The method according to claim 12, wherein said first plurality of parallel members has a different number of members per unit length as said second plurality of parallel members, thereby forming generally rectangular compartments in said support grid.

17. A display apparatus, comprising:

a grid structure having a first plurality of parallel members that intersect a second plurality of parallel members at a predetermined angle, said first and second plurality of members having two side edges and uniform thickness between said side edges, wherein the intersection of said first and second plurality of parallel members define a plurality of identical apertures in said grid structure, said first plurality of members having a given number of members per unit length, said second plurality of members having said given number of members per unit length, thereby forming generally square compartments in said grid structure;

at least one planar support having a top edge, a bottom edge, a left edge and a right edge;

means for retaining an object to be displayed on said planar support; and attachment means for selectively attaching said at least one planar support to said grid structure, wherein said top edge and bottom edge of said at least one planar support align with one of said side edges of two of said first plurality of parallel members and said left and right edges of said planar support align with one of said side edges of two of said second plurality of parallel members.

* * * * *